US005168819A

United States Patent [19]

Semedard et al.

[11] Patent Number: 5,168,819

[45] Date of Patent: Dec. 8, 1992

[54] APPARATUS FOR COOLING A MIDDLE REGION OF THE WALL OF A HEARTH IN A FLUIDIZED BED BOILER

[75] Inventors: Jean-Claude Semedard; Jean-Paul Tessier, both of Paris; Jean Aubry, Le Plessis Robinson; Gérard Tondeur, Jouy en Josas, all of France

[73] Assignee: Stein Industrie, Velizy-Villacoublay, France

[21] Appl. No.: 765,747

[22] Filed: Sep. 26, 1991

[30] Foreign Application Priority Data

Sep. 26, 1990 [FR] France ..... 90 11859
Mar. 27, 1991 [FR] France ..... 91 03700

[51] Int. Cl.[5] ..... B09B 3/00

[52] U.S. Cl. ..... 110/245; 34/57 A; 34/57 B

[58] Field of Search ..... 34/57 R, 57 A, 57 B, 34/57 C; 432/58; 110/234, 245

[56] References Cited

U.S. PATENT DOCUMENTS 4,823,740 4/1989 Ohshita et al. ..... 110/245 X

FOREIGN PATENT DOCUMENTS 0289974 11/1988 European Pat. Off. .
7812736 4/1978 France .
WO9009550 8/1990 PCT Int'l Appl. .

OTHER PUBLICATIONS

"Umweltkraftwerk mit druckvirbel-schichtfeurerung", J. Bulbring, et al., BWK Brennstoff Warme Kraft, vol. 36, No. 10, Oct. 1984, pp. 405–409.

"Umweltfreundliches Kraftwerk mit Druckveirbel-schichtfuerung", Von D. Bunthoff et al., VGB Kraftswerkstechnik, vol. 67, No. 8, Aug. 1987, pp. 751–757.

French Search Report.

*Primary Examiner*—Henry A. Bennet
*Attorney, Agent, or Firm*—Sughrue, Mion, Zinn, Macpeak & Seas

[57] ABSTRACT

Apparatus for cooling the wall of a fluidized bed hearth in a middle join region of generally upsidedown V-shaped vertical right cross-section between the upside-down truncated pyramid-shaped bottom portions of the furnace above two parallel floors and a top portion of rectangular right cross-section, having a front face and a rear face parallel to the ridge of the upsidedown V-shape and having side faces perpendicular to said ridge, said wall being provided with heat exchanger tubes conveying water or an emulsion of water and steam, wherein the heat exchanger tubes are essentially horizontal and disposed in the flanks of the upsidedown truncated pyramid-shaped lower portions in line with the upsidedown V-shape and open out into tubes lining the side faces perpendicular to the ridge thereof. This makes it possible to perform cooling by natural circulation.

12 Claims, 2 Drawing Sheets

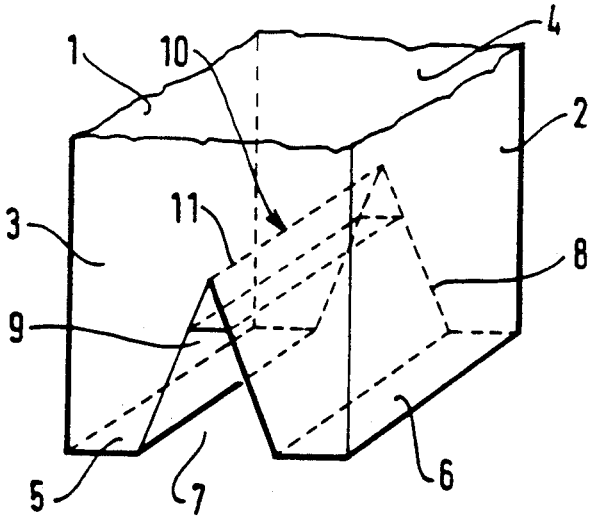
FIG.1
FIG.2
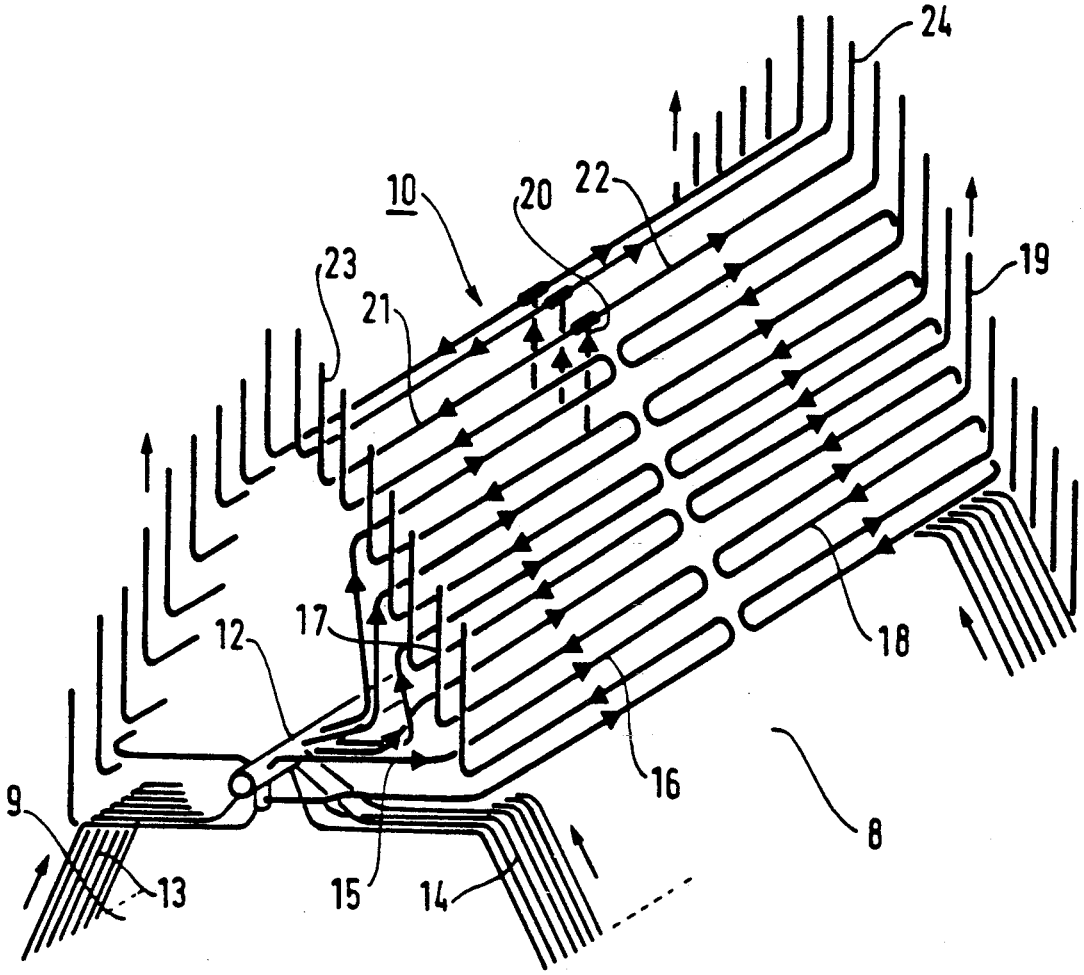

APPARATUS FOR COOLING A MIDDLE REGION OF THE WALL OF A HEARTH IN A FLUIDIZED BED BOILER

FIELD OF THE INVENTION

The present invention relates to an apparatus for cooling the wall of a fluidized bed hearth in a middle join region having a vertical right cross-section which is generally in the form of an upsidedown V shape and which is located between the upsidedown truncated pyramid-shaped bottom portions of the furnace above two parallel floors and a top portion of the furnace which top portion is of rectangular right cross-section, having a front face and a rear face that are parallel to the ridge of the upsidedown V-shape and having side faces that are perpendicular to said ridge, said wall being provided with heat exchanger tubes conveying water or an emulsion of water and stream, the sloping faces of the upsidedown V-shape being provided with sloping heat exchanger tubes parallel to the side edges of the upsidedown V-shape.

BACKGROUND OF THE INVENTION

In the past no satisfactory solution has been found for cooling said region by natural circulation of the water and of the emulsion of water and steam to be heated and vaporized. It has therefore been necessary to place tubes therein that are fed by means of forced circulation pumps drawing from tubes lining the vertical walls of the hearth via lengths that include portions extending downwards.

An object of the present invention is to provide apparatus for cooling such a natural circulation region by means of a system of continuous tubes including no portions extending downwards.

SUMMARY OF THE INVENTION

To do this, in the present invention, the sloping tubes are connected to substantially horizontal heat exchanger tubes disposed in the flanks of the lower portions of the upsidedown truncated pyramids in line with the upsidedown V-shape and extending to the vicinity of the side faces where they open out into vertical tubes fitted to the side faces of the hearth.

Preferably, in order to equip both side faces in uniform manner, all of the tubes are disposed symmetrically about a plane of symmetry parallel to the side faces of the hearth.

In a first variant, the heat exchanger tubes in the middle region are connected to the tubes disposed over the flanks of the upsidedown truncated pyramid lower portions via a manifold disposed beneath the wall of the middle region, vertically relative to the ridge of the upsidedown V-shape.

In which case, the apparatus preferably further satisfies at least one of the following features:

at least a major fraction of the horizontal tubes are hairpin-shaped.

some of the tubes disposed in the vicinity of the ridge of the upsidedown V-shape are rectilinear and are fed centrally;

the hairpin-shaped tubes are fed via their ends in the vicinity of the side faces of the hearth; and the flanks of the portion of the middle region closest to the ridge form a greater angle relative to the vertical plane than do the flanks of the portion of the middle region that are further from the ridge.

In a second variant, the sloping tubes are connected in groups of n sloping tubes to the substantially horizontal heat exchanger tubes referred to as "connection" tubes.

In order to obtain a uniform distribution of vertical tubes over each of the side faces and of connection tubes over the sloping faces, the groups of n sloping tubes are preferably connected to their respective connection tubes at different heights, the various connection tubes being superposed over one another in the sloping faces.

More precisely, said heights increase regularly from the group of n sloping tubes closest to one of the side faces to the group of n sloping tubes closest to said plane of symmetry, the last-mentioned group extending to the vicinity of the ridge of the middle region.

In order to ensure that the pitch between the vertical tubes is large enough given the welded fins that interconnect the tubes on a continuous basis, according to a particular characteristic, the groups of n sloping tubes are connected in pairs in sets of 2n sloping tubes by means of the connection tubes, which connection tubes are connected at their mutual interconnections to a corresponding vertical tube.

Finally, in order to enable the apparatus to be implemented by means of standard T or L tube connection pieces, and in order to obtain optimum flow balancing, according to another characteristic of the invention, said interconnection between two connection tubes is constituted by a hairpin-shaped extension of the connection tube for the group of n sloping tubes closest to one of the side faces of the hearth, such that the outlet from the hairpin bend is in alignment with the connection tube of the other group of n sloping tubes.

BRIEF DESCRIPTION OF THE DRAWINGS

Embodiments of the invention are described by way of example with reference to the accompanying drawings, in which:

FIG. 1 shows the general disposition of the middle region between the two bottom legs of a boiler hearth having two separate floors and including the apparatus of the invention.

FIG. 2 is on a larger scale and shows a first variant of the way in which the tubes may be disposed in this zone.

DETAILED DESCRIPTION

Figure 3:
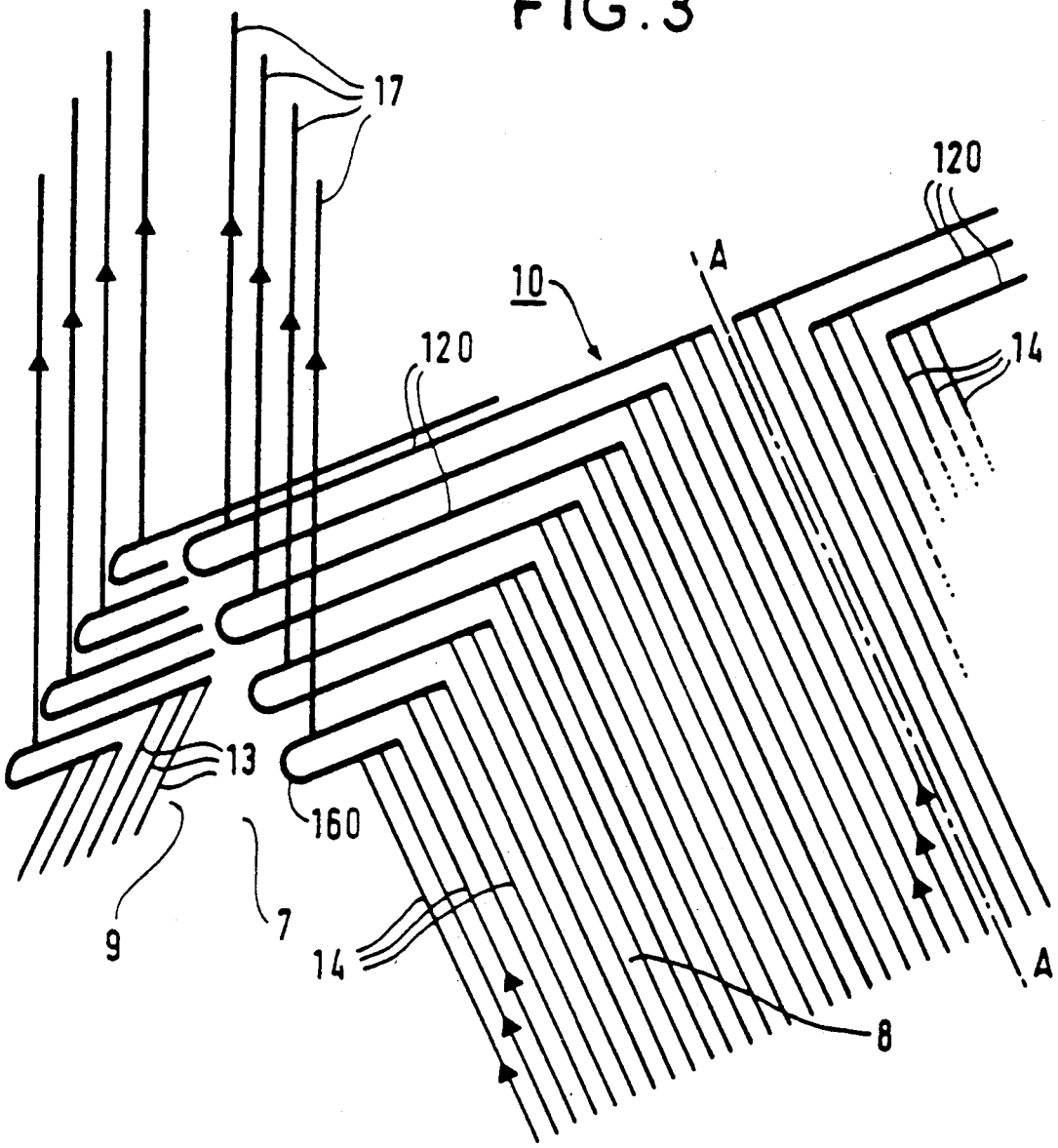
FIG. 3 is on a larger scale and shows a second variant of the way in which the tubes may be disposed in this zone.

In FIG. 1 the hearth has a front face 1, a rear face 2, and two side faces 3 and 4. Its two floors are separated by a gap 7 such that the two bottom portions of the hearth comprise a pair of legs including sloping flanks 8 and 9 and that are interconnected in a top region 1-along a ridge 11 extending parallel to the front and rear faces of the hearth.

In FIG. 2, a cooling manifold 12 for feeding water or an emulsion of water and steam is disposed in the plane of symmetry of the hearth parallel to its front and rear faces 1 and 2 and is protected from the flue gases of the furnace. It is connected on either side to inlet tubes 13 and 14 disposed on the "sloping vault" flanks 8 and 9 that are inclined at 24° to the vertical, and in turn it feeds tubes such as 15 connected it to hairpin bend tubes such as 16 and 18 disposed on the wall of the top region. The tubes 16 and 18 are interconnected continuously by means of welded fins (not shown) and they are connected to vertical tubes such as 17 and 19 which rise along the side faces 3 and 4 of the hearth.

The manifold 12 is also connected via vertical tubes such as 20 in the vicinity of the plane of symmetry parallel to the side faces 3 and 4 of the furnace to horizontal rectilinear tubes such as 21 and 22 which diverge on either side of said plane of symmetry and which are disposed in the region 20 close to the top ridge 11 and which open out into vertical tubes 23 and 24 on the side faces. The tubes such as 21 and 22 are preferably disposed on face portions making a greater angle to the vertical, e.g. 55°, such that the ridge 11 in FIG. 1 becomes a virtual ridge. These tubes are also interconnected by fins (not shown).

Apparatus in accordance with the second variant is shown in FIG. 3.

The "sloping vault" inlet tubes 13 and 14 at an angle of 24° relative to the vertical are disposed on the surfaces of the sloping flanks 8 and 9.

To do this, the sloping tubes 13 and 14 are connected together in groups of n sloping tubes. In the example shown, the sloping tubes are connected together in groups of three. The number of sloping tubes per group is defined as a function of the desired outlet flow rate from the vertical tubes 7 on the side walls of the hearth.

The tubes are disposed symmetrically about the central vertical plane parallel to the side faces 3 and 4 of the furnace, with half of the sloping tubes 13 and 14 being connected to the vertical tubs 17 over side face 3 and with the other half being connected to the vertical tubes 17 over the other side face 4. This plane of symmetry is symbolized in FIG. 3 by dot-dashed line A—A.

The sloping tubes 13, 14 are terminated in groups of three at different heights, with the group closest to the plane symbolized by line A—A going to a point close to the ridge 10 in the region 10.

Where they are terminated, the sloping tubes are connected to substantially horizontal tubes 120 preferably by means of conventional T and L couplings, with the substantially horizontal tubes being likewise disposed on the sloping faces 8 and 9 of the region 10. These couplings are disposed so as to obtain a constant pitch between superposed tubes 120 on the sloping faces.

In order to obtain a pitch of sufficient size between the vertical tubes 17, the horizontal tubes 12 are connected together in pairs prior to being connected to a vertical tube 17.

Such connection in pairs is achieved by means of hairpin bend extensions 160 between pairs of adjacent tubes 120. Each extension 160 projects outside the zone 10. It serves firstly to enable a conventional T coupling to be used where the connection is made to the corresponding vertical tube 17, and secondly to balance the lengths and the flows reaching said connection.

In conventional manner, the tubes are interconnected in the plane by welded fins (not shown) other than in the overflow region from the region 10, i.e. except for the hairpin bends 160.

By way of example, the region 10 may have a height of about 2.7 meters (m), with the pitch between the sloping tubes 13, 14 being about 88 mm, with these tubes having a diameter of about 44.5 mm, with the pitch between the horizontal tubes 120 being about 94 mm, the pitch between the vertical tubes being about 76.5 mm, and with the diameter of the vertical tubes being about 63.5 mm.

These heat exchange tube dispositions in the top portion of the upsidedown V-shaped region between the two bottom portions of the hearth make it possible to use natural circulation for the water or the water and steam emulsion in the tubes, while still fully protecting the feed manifold and the corresponding walls from hearth radiation.

We claim:

1. Apparatus for cooling the wall of a fluidized bed hearth in a middle join region having a vertical right cross-section which is generally in the form of an upsidedown V-shape and which is located between the upsidedown truncated pyramid-shaped bottom portions of the furnace above two parallel floors and a top portion of the furnace, which top portion is of rectangular right cross-section, having a front face and a rear face that are parallel to the ridge of the upsidedown V-shape and having side faces that are perpendicular to said ridge, said wall being provided with heat exchanger tubes conveying water or an emulsion of water and steam, the sloping faces of the upsidedown V-shape being provided with sloping heat exchanger tubes parallel to the side edges of the upsidedown V-shape, wherein the sloping tubes are connected to substantially horizontal heat exchanger tubes disposed in the flanks of the lower portions of the upsidedown truncated pyramids in line with the upsidedown V-shape and extending to the vicinity of the side faces where they open out into vertical tubes fitted to the side faces of the hearth.

2. Apparatus according to claim 1, wherein all of the tubes are disposed symmetrically about a plane of symmetry parallel to the side faces of the hearth.

3. Apparatus according to claim 1, wherein the heat exchanger tubes in the middle region are connected to the tubes disposed over the flanks of the upsidedown truncated pyramid lower portions via a manifold disposed beneath the wall of the middle region, vertically relative to the ridge of the upsidedown V-shape.

4. Apparatus according to claim 3, wherein at least a major fraction of the horizontal tubes are hairpin-shaped.

5. Apparatus according to claim 1, wherein some of the tubes disposed in the vicinity of the ridge of the upsidedown V-shape are rectilinear and are fed centrally.

6. Apparatus according to claim 4, wherein the hairpin-shaped tubes are fed via their ends in the vicinity of the side faces of the hearth.

7. Apparatus according to claim 1, wherein the flanks of the portion of the middle region closest to the ridge form a greater angle relative to the vertical plane than do the flanks of the portion of the middle region that are further from the ridge.

8. Apparatus according to claim 1, wherein the sloping tubes are connected in groups of n sloping tubes to the substantially horizontal heat exchanger tubes referred to as "connection" tubes.

9. Apparatus according to claim 8, wherein the groups of n sloping tubes are connected to their respective connection tubes at different heights, the various connection tubes being superposed over one another in the sloping faces.

10. Apparatus according to claim 9, wherein said heights increase regularly from the group of n sloping tubes closest to one of the side faces to the group of n sloping tubes closest to said plane of symmetry, the last-mentioned group extending to the vicinity of the ridge of the middle region.

11. Apparatus according to claim 9, wherein the groups of n sloping tubes are connected in pairs in sets of 2n sloping tubes by means of the connection tubes which connection tubes are connected at their mutual interconnections to a corresponding vertical tube.

12. Apparatus according to claim 11, wherein said interconnection between two connection tubes is constituted by a hairpin-shaped extension of the connection tube for the group of n sloping tubes closest to one of the side faces of the hearth, such that the outlet from the hairpin bend is in alignment with the connection tube of the other group of n sloping tubes.

* * * * *